US006708608B2

(12) United States Patent
Viljanmaa

(10) Patent No.: US 6,708,608 B2
(45) Date of Patent: Mar. 23, 2004

(54) DEVICE AND METHOD PREVENTING EVAPORATION OF MOISTURE AND HEAT LOSSES IN CALENDERING

(75) Inventor: Mika Viljanmaa, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/181,880

(22) PCT Filed: Jan. 22, 2001

(86) PCT No.: PCT/FI01/00053

§ 371 (c)(1),
(2), (4) Date: Jul. 23, 2002

(87) PCT Pub. No.: WO01/55503

PCT Pub. Date: Aug. 2, 2001

(65) Prior Publication Data

US 2003/0010461 A1 Jan. 16, 2003

(30) Foreign Application Priority Data

Jan. 25, 2000 (FI) ..... 20000145

(51) Int. Cl.[7] ..... B30B 15/34; D21G 1/00

(52) U.S. Cl. ..... 100/38; 100/75; 100/161; 100/138; 162/205; 162/206; 162/361

(58) Field of Search ..... 100/38, 41, 137, 100/138, 142, 144, 73, 92, 317, 333, 162 R, 163 A, 161; 162/205, 206, 361

(56) References Cited

U.S. PATENT DOCUMENTS

| | | | | | |
|---|---|---|---|---|---|
| 4,497,246 | A | * | 2/1985 | Pav et al. | 100/35 |
| 4,642,164 | A | | 2/1987 | Hanhikoski et al. | 162/207 |
| 4,711,102 | A | * | 12/1987 | Sando et al. | 68/5 E |
| 4,873,846 | A | * | 10/1989 | Talbert, Jr. | 68/5 E |
| 5,065,673 | A | * | 11/1991 | Taylor et al. | 100/40 |
| 5,669,295 | A | | 9/1997 | Kayser et al. | 100/331 |
| 6,003,440 | A | * | 12/1999 | Koskinen et al. | 100/35 |
| 6,199,477 | B1 | * | 3/2001 | Brendel et al. | 100/162 R |
| 6,245,198 | B1 | * | 6/2001 | Kinnunen et al. | 162/360.3 |

FOREIGN PATENT DOCUMENTS

| | | | |
|---|---|---|---|
| CA | 2181323 | 2/1997 | D21G/1/00 |
| FI | 92850 B | 9/1994 | D21G/1/00 |

* cited by examiner

*Primary Examiner*—Allen Ostrager
*Assistant Examiner*—Jimmy Nguyen
(74) *Attorney, Agent, or Firm*—Cohen, Pontani, Lieberman & Pavane

(57) ABSTRACT

The invention relates to a calender intended to calender a paper or board web (4), which calander comprising a calendering section, in which there are at least two members, such as rolls (1, 2, 3), in nip contact, between which the web (4) being calendered is arranged to run. For reducing the moisture and heat leaving the web (4) while it is being calendered a wall (16, 17), covering at least part of the calendering section, is formed from the web (4) being calendered by changing its direction of travel.

10 Claims, 2 Drawing Sheets

DEVICE AND METHOD PREVENTING EVAPORATION OF MOISTURE AND HEAT LOSSES IN CALENDERING

PRIORITY CLAIM

This is a national stage of PCT application No. PCT/FI01/00053 filed on Jan. 22, 2001. Priority is claimed on that application and on Application No.: 20000145, filed in Finland on Jan. 25, 2000.

The present invention relates to a device and a method for calendaring a paper or board web.

The present invention relates to a calender according to the preamble of claim 1 and a method according to the preamble of claim 6 for calendering a paper or board web.

When paper and board are calendered, the web is processed in a nip formed between two opposing rolls. In addition to the rolls, the nip can be formed of other members arranged opposite to each other, such as the shoes of a shoe-press calender. Calendering is generally carried out using a machine calender, a soft calender, or a multi-roll calender, such as a super calender. In all of these types of calender, heat, moisture, and the pressure of the nip on the web are used to polish the paper and make it smoother. Hard and soft rolls are usually used in the nips. The surface of the soft rolls is made from paper or some other suitable fibrous material, or increasingly nowadays from polymeric materials developed for this purpose. The hard rolls are generally manufactured from cast iron and can be heated by means of oil, steam, or in other ways, for example, by induction heating.

Calendering is intended to increase the smoothness and gloss of the paper or board and to improve other properties of the printing surface. Improved properties of the printing surface will improve the quality of the final printed surface. The quality of the printed surface and good printability are the most important quality factors valued by the users of paper. The printability and printed surface quality are also important in printing boards, in which a high degree of stiffness and good bulk are also often valued. Yet another factor affecting the quality of the product is the evenness of the cross-direction profile of the web, i.e. there should be as little variation as possible in thickness over the transverse direction of the web.

When a web is calendered, its surface is evened by directing high pressure and great heat onto the web by heating the hard rolls of the calender and pressing the rolls against each other to create a high nip pressure in the nip formed by the rolls. These forces cause the fibres forming the web to reach their glass transition temperature, at which the deformation caused by the nip load becomes permanent. The slipping of the surface of the web on the roll surfaces can also cause deformation of the fibres and reinforce the smoothing effect.

In multi-roll calendering, the paper is manufactured normally in a paper machine and coated if necessary. In both cases, the coated or uncoated paper is generally wound onto storage reels and calendered in separate off-line calenders. The paper is dried to a very low moisture content, typically 1–3% of its total weight. Before calendering, the paper is dampened sufficiently to achieve a good calendering result. A suitable moisture content for multi-roll calendering is about 6–10%. Drying to a low moisture content is intended to even the web's cross-direction moisture profile. A short period of storage prior to calendering will also even the moisture profile. In modern on-line calendering processes, the web is dried to a very low moisture content and dampened again before calendering, so that the process is similar to off-line calendering.

Drying and re-wetting increases the consumption of energy required to make the product and the space required for the equipment, compared to a process in which over-drying and re-wetting are not required before calendering. Uneven moisture, for instance, in the surface moisture or in the moisture profile in some direction of the web, will lead to changes in the web's properties, such as in the gloss or thickness profile, because moisture greatly affects the formability of the fibres. If the thickness profile is uneven, the web becomes difficult to wind and transverse creases may even form in the customer reels, because the tension in the reel cannot be made even. Creases reduce the product's runnability in processing machines, for example, in printing presses, thus reducing the product's quality from the customer's point of view.

The moisture profile affects many aspects in the manufacture of paper or board and in the final quality of the product. For example, if variations occur in the moisture content, the drier parts of the web will shrink before the damper parts, which will lead to stretching in the damper parts. Uneven stretching results in uneven drying shrinkage, which leads in turn to variations in the web thickness and in many other properties of the product.

If the web to be calendered is stored prior to calendering, as is usually the case in off-line calendering, the moisture differences even out and the stresses relax, so that it is not quite so important for the moisture content of the web to be even before storage. However, if on-line calendering is used, the product's quality will be greatly affected by the evenness of the moisture content prior to calendering, and if existing methods and principles are used to control the web's moisture content, the properties of the calendered paper may even suffer, preventing the desired improvement in the properties of the end product.

Modern calenders run at very high speeds, so that the calendering temperatures and nip loads must be increased to achieve the desired calendering result. The increased temperatures of the thermo-rolls and the increased nip loads evaporate even more water than before from the web, so that the desired final moisture content of the web at the winder can only be maintained by reducing the number of calendering stages or wetting the web more that before. However, reducing the calendering stages worsens the calendering result while the alternate drying and wetting of the web considerably increases the energy consumption in the calendering process.

The problems described above can be reduced by means of, for example, the solution disclosed in FI patent publication 92850, in which at least part of the calender is surrounded with a casing, which prevents the moisture and heat that leave the web from escaping from the calendering space. In that case, the humidity of the air in the calendering space increases considerably, so that the web being calendered dries less. The problem with using a casing surrounding the calender is that moisture begins to condense on the inside of the casing then drips onto the web being calendered, thus impairing the result of the calendering and the runnability of the calender. In addition, the casing surrounding the calender's rolls hampers roll changes, besides being quite expensive.

SUMMARY OF THE INVENTION

The invention is intended to reduce the defects of the state of the art disclosed above and for this purpose create an entirely new type of calender.

The invention is based on limiting the evaporation of moisture and heat from the web during calendering by means of a wall covering the calender and formed with the aid of the web being calendered. The web is brought to the calender and taken from it in such a way that the web forms a moving wall in front of and behind the set of rolls in the calender. In addition, surfaces are placed at the end of the calender's set of rolls, preventing the evaporation of moisture and heat through the ends.

The invention offers significant benefits.

The calendering section of the calender according to the invention is at least partly isolated from its surroundings, so that less moisture and heat leaving the web evaporates, which considerably reduces the drying of the web being calendered and the need to wet it, and cuts the energy consumption of the calender. The web can be calendered in each nip in nearly the same optimal humidity, so that the number of nips need not be reduced due to the web drying. The cross-direction moisture profile is considerably more even than in conventional calenders, because the evaporation of moisture through the ends to outside the calendering section is reduced.

The problems arising from a web that is wound when hot are also reduced, because the wall formed by the web behind the calendering section increases the distance travelled by the web before it arrives at the winder, allowing the web to cool more and reducing its winding temperature. In this case, separate cooling cylinders may not be needed to cool the web after the calender. In addition, in the calender according to the invention, the moisture content of the web being calendered can be adjusted on one side, by steaming the space between the calender's rolls and the web being calendered.

The wall of the calender according to the invention, formed by the web being calendered, does not hamper roll changing, as the wall is in place only during calendering and automatically disappears when a web break occurs. The moisture evaporating from the web being calendered has practically no chance to condense on the surface of the moving wall, so that moisture cannot drip onto the web and thus impair the calendering finish and the runnability of the calender. The formation of the wall surrounding the calender requires only a few extra rolls guiding the web, so that the solution according to the invention can be constructed easily and economically in both new and existing calenders. In addition, the solution according to the invention can be applied to all known types of calenders.

BRIEF DESCRIPTION OF THE DRAWINGS

In the following, the invention is examined with aid of examples and with reference to the accompanying drawings.

DETAILED DESCRIPTION OF THE PRESENTLY PREFERRED EMBODIMENTS

Figure 1:
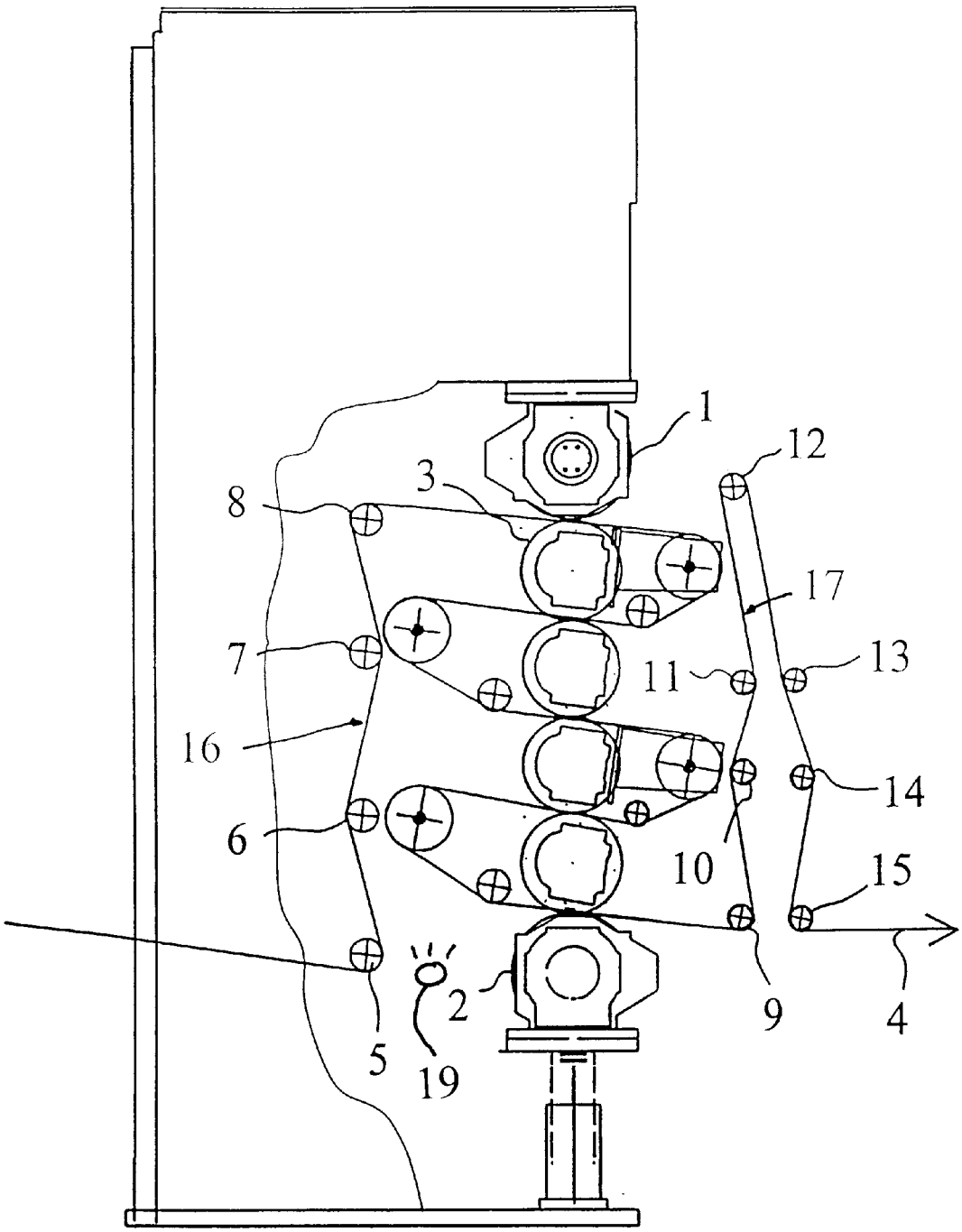
FIG. 1 shows a side view of one calender according to the invention, without end surfaces.

The multi-roll calender shown in FIG. 1 includes a calendering section, in which there is a top 1 and a bottom roll 2, with intermediate rolls 3 arranged between them. While the calender is running, the stacked rolls 1, 2, 3 are in mutual nip contact. The web 4 being calendered runs through the stacked nips, from the top to the bottom. The direction of travel of the web 4 is marked in the drawing with an arrow.

Before the web 4 arrives at the calendering section of the calender, its direction of travel is altered with the aid of guide rolls 5–8. Guide roll 5 is used to first of all turn the web 4 upwards, after which it runs through the guide rolls 6, 7 to guide roll 8, which turns the web 4 towards the calender's uppermost nip, i.e. that formed by the top roll 1 and the uppermost intermediate roll 3. Thus the web 4 forms a vertical wall 16 between the guide rolls 5 and 8, which at least partly covers the calendering section, and which prevents the moisture and heat removed from the web 4 in connection with calendering from evaporating outside the calendering section.

After having run through the lowest nip, i.e. the nip formed by the bottom roll 2 and the lowest intermediate roll 3, the web 4 is taken to guide roll 9, which turns the direction of travel of the web 4 upwards. Next, the web 4 runs through guide rolls 10, 11 to guide roll 12, which turns the direction of travel of the web 4 downwards. After the guide roll 12, the web 4 is taken through guide rolls 13 and 14 to guide roll 15, which turns the direction of travel of the web 4, for example, towards the winder. Thus, between the guide rolls 9 and 12, the web 4 forms a vertical wall 17, which at least partly covers the calendering section, and prevents the moisture and heat leaving the web 4 in connection with calendering from evaporating outside the calendering section. Due to the long web transfer, the web 4 can cool before winding, thus reducing the problems caused by winding the web 4 when it is still warm.

Figure 2:
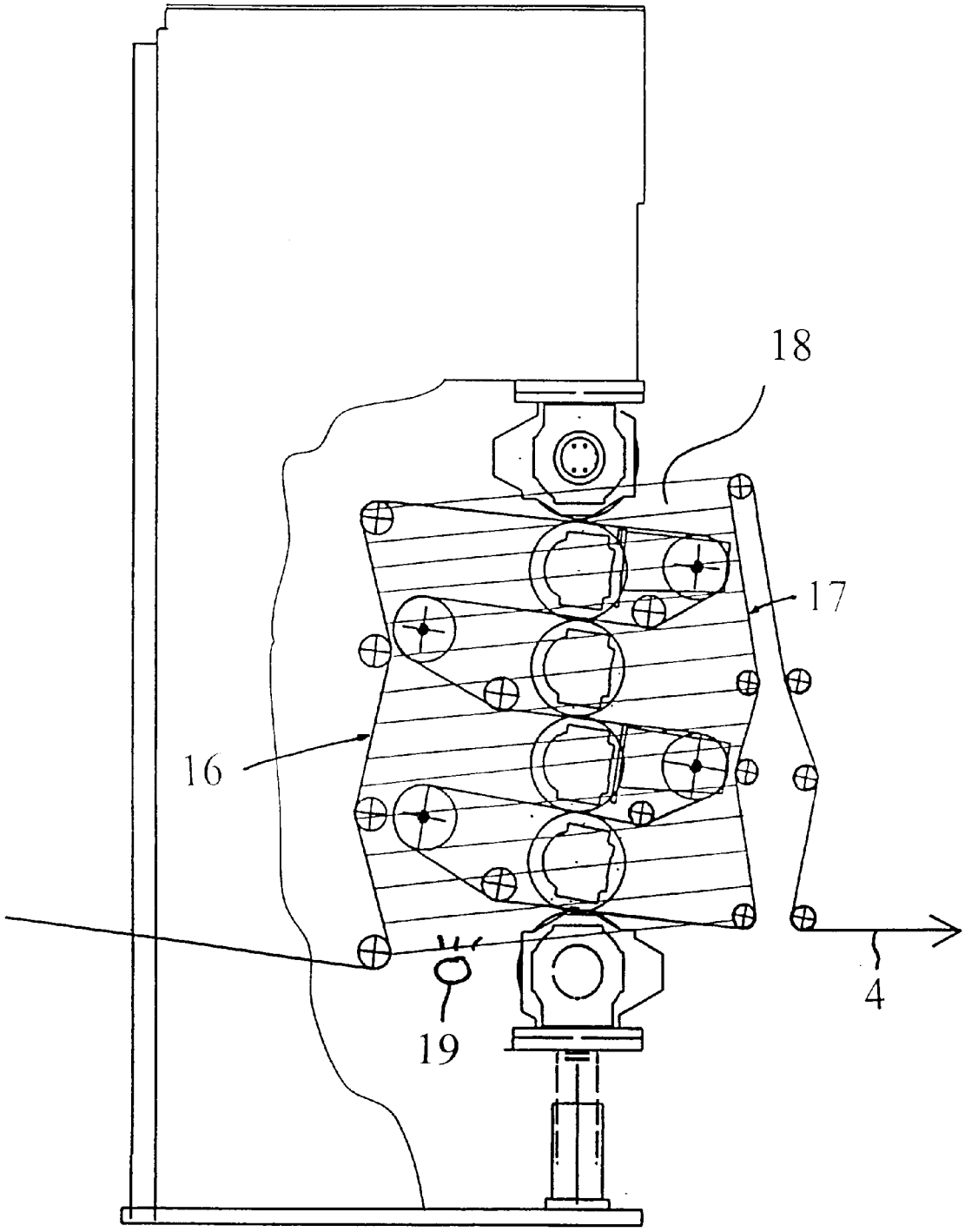
FIG. 2 shows the calender of FIG. 1, with one preferred location for the end surfaces indicated by diagonal shading.

Surfaces, for instance plates, are placed on both sides of the calender and limit the flow of air through the ends, as well as the evaporation of moisture and heat outside the calendering section. The surfaces are preferably located at the ends, for example, in the area shaded in FIG. 2. In FIG. 2, the end plates are located close to the edges of the web 4 between the walls 16, 17 formed in front of and behind the calendering section with the aid of the web 4, so that the walls 16, 17 together with the end surfaces 18 create a cover around the calendering section that reduces the evaporation of moisture and heat.

The moisture content of the web 4 being calendered can be adjusted on one side by steaming the space between the wall 16, 17 formed by the web 4 being calendered and the calender's set of rolls, either before or after calendaring, such as by using a steam nozzle 19 or other means for introducing steam. The walls 16, 17 and the end surfaces 18 then prevent the moisturizing steam from evaporating outside the calender, thus reducing the amount of steam required for moisturizing and equalizing the distribution of moisture over the web 4.

The invention also has alternative embodiments, differing from those disclosed above.

The solution according to the invention can also be applied in other types of calender than the multi-roll calender described above. There are also other forms of web transfer, differing from those in the example disclosed above, by means of which walls 16, 17 covering the sides of the calendering section can be formed. If necessary, a wall 16, 17 can be formed only in front of or behind the calendering section. Similarly, if necessary, it is possible to cover only one of the ends of the calendering section with an end surface 18.

What is claimed is:

1. A calender for a moving paper or board web comprising:

a calendering section comprising a plurality of members to calender a portion of a moving web of paper or board; and at least one wall for reducing moisture and heat loss from the web while the portion of the web is calendered, the at least one wall being positioned to cover at least part of the calendering section and being formed by the web and being formed by turning a direction of travel of the web, wherein the at least one wall comprises a first wall positioned in front of the calendering section in the direction of travel of the web and a second wall positioned behind the calendering section in the direction of travel of the web.

2. The calender of claim 1, further comprising a surface positioned adjacent an edge of the web being calendered on at least one side of the calendering section to further reduce moisture and heat loss from the web during calendering.

3. The calender of claim 2, wherein the surface extends between both ends of the calendering section.

4. The calender of claim 1, further comprising a plurality of guide rolls positioned to turn the direction of travel of the web to form the at least one wall.

5. The calender of claim 2, further comprising a plurality of guide rolls positioned to turn the direction of travel of the web to form the at least one wall.

6. The calender of claim 3, further comprising a plurality of guide rolls positioned to turn the direction of travel of the web to form the at least one wall.

7. The calender of claim 1, further comprising a means for introducing steam between the at least one wall and the calendering section to adjust the moisture content of the web.

8. A method for calendering a moving paper or board web comprising:

transporting a moving web of paper or board to a calender;

calendering a portion of the web in a calendering section comprising a plurality of members to calender the web;

covering at least part of the calendaring section with at least one wall to reduce moisture and heat loss from the web while the web is calendered, the at least one wall being positioned to cover at least part of the calendering section and being formed by the web and being formed by turning a direction of travel of the web, wherein the at least one wall comprises a first wall positioned in front of the calendering section in the direction of travel of the web and a second wall positioned behind the calendering section in the direction of travel of the web.

9. The method of claim 8, wherein the at least one wall is formed by turning the direction of travel of the web with the aid of guide rolls.

10. The method of claim 8, further comprising adjusting the moisture content of the web by introducing steam between the at least one wall and the calendering section.

* * * * *